US005960657A

United States Patent [19]

Anbe et al.

[11] Patent Number: 5,960,657

[45] Date of Patent: Oct. 5, 1999

[54] METHOD AND APPARATUS FOR THE CONTROL OF ROLLING MILLS

[75] Inventors: Yoshiharu Anbe; Tomoyuki Tezuka, both of Tokyo, Japan

[73] Assignee: Kabushiki Kaisha Toshiba, Kawasaki, Japan

[21] Appl. No.: 09/008,301

[22] Filed: Jan. 16, 1998

[30] Foreign Application Priority Data

Jan. 16, 1997 [JP] Japan ..... 9-005788

[51] Int. Cl.[6] ..... B21B 37/28

[52] U.S. Cl. ..... 72/9.1; 72/11.7; 72/12.7

[58] Field of Search ..... 72/8.8, 8.9, 9.1, 72/9.2, 9.4, 9.5, 10.1, 10.4, 11.6, 11.7, 12.1, 12.7, 234, 365.2

[56] References Cited

U.S. PATENT DOCUMENTS

| | | | |
|---|---|---|---|
| 4,400,957 | 8/1983 | Carlstedt et al. | 72/9.1 |
| 4,805,492 | 2/1989 | Tsuruda | 72/9.1 |
| 5,493,885 | 2/1996 | Nomura et al. | 72/9.1 |
| 5,509,285 | 4/1996 | Ande | 72/9.1 |
| 5,546,779 | 8/1996 | Ginzburg | 72/11.7 |

OTHER PUBLICATIONS

Nishiyama, et al., The Iron and Steel Institute of Japan, Development and Prospect of Theory and Technology of Steel Rolling, pp. 79–90, Jun. 1994, "Hot Rolling Technology for Improvement of Dimensional Accuracy".

*Primary Examiner*—Joseph J. Hail, III
*Assistant Examiner*—Ed Tolan
*Attorney, Agent, or Firm*—Oblon, Spivak, McClelland, Maier & Neustadt, P.C.

[57] ABSTRACT

The present invention includes the following constituent elements, namely:

firstly, calculation of the set-up rolling conditions having the target values of rolling load, strip width and strip crown and the set values of the actuators on the basis of externally given rolling information before rolling of the stock materials; followed by measurement of the rolling status including rolling load, strip width and strip crown during rolling of the stock materials, and calculation of the deviations between the observed values of rolling status for the previous strip and the calculated values of the set-up rolling conditions for the next strip corresponding to the said observed values; and further followed by successive correction of the actuator set values in respect of the next strip on the basis of the deviations between the respective observed values of rolling status for the previous strip and the respective calculated values or the set-up rolling conditions for the next strip when the deviation between the target strip crown for the previous strip and the target strip crown for the next strip is zero in rolling the next strip after rolling the previous strip.

By virtue of being so constituted, the present invention is able to finish the strip crown and strip flatness of the succeeding stock material to target values with high precision without recourse to the use of crown ratio heredity coefficients and shape disturbance coefficients by utilizing the rolling results for the previous strip for rolling control of the next strip.

18 Claims, 3 Drawing Sheets

METHOD AND APPARATUS FOR THE CONTROL OF ROLLING MILLS

BACKGROUND OF THE INVENTION

1. Field of the Invention

The present invention relates to a method and apparatus for rolling mill control ideally suited to continuous rolling mills arranged in tandem, and more particularly relates to a method and apparatus for obtaining a desired strip crown and strip flatness.

2. Description of the Related Art An example of the prior art is a control system aimed at achieving a target strip crown and target strip shape described under the title "High precision rolling in hot strip mills" (authors: Yasuyuki Nishiyama, Nobuji Shibao, Satoshi Shimazu et al) on pages 79–90 of the Iron & Steel Institute of Japan Rolling Theory Section's 100th Symposium "Rolling Technology. and Theory: Development and Future Trends" (June 1994). As initial set-up functions, this control system has functions for determining the initial set values of work roll pair-cross angle and work roll bending force in each stand for achieving a target strip crown and target strip shape.

The aforementioned system uses the strip crown ratio heredity coefficient and shape coefficient for improving the precision of strip thickness in the transverse direction, but the actual determination of these coefficients has been beset by difficulty.

Moreover, the account of the aforementioned system makes no mention of utilizing the results from rolling of the previous strip, i.e. strip rolled earlier in time sequence when successive stock material is rolled with the rolling mill, for rolling the next strip, i.e. strip rolled later in time sequence; and makes no mention of the case where the rolling conditions are different for the previous strip and next strip.

SUMMARY OF THE INVENTION

Accordingly, one of the objects of the present invention is to provide a method and apparatus for the control of rolling mills that enable the strip crown and strip flatness of the succeeding stock material to be finished to target values with high precision without recourse to the crown ratio heredity coefficient and shape disturbance coefficient by effectively utilizing the rolling results for the previous strip for rolling control of the next strip.

The aforesaid object of the present invention is attained by providing a method and apparatus for rolling mill control that have the following constitution.

Thus, the present invention is so constituted that, in controlling a plurality of rolling mills arranged in tandem each possessing an actuator for controlling the strip crown:

the set-up rolling conditions comprising the target values of rolling load, strip width and strip crown and the actuator set values for the stock material to be rolled first, are calculated on the basis of externally provided rolling information before rolling of the stock material, the rolling status including rolling load, strip width and strip crown is measured during rolling of the stock material, the deviations are calculated between the respective observed values of rolling status for the previous strip, wherein leading strip denotes the stock material rolled earlier in time sequence in the successive rolling of stock material with the rolling mills, and the respective calculated values of the set-up rolling conditions for the next strip corresponding to the said observed values, wherein next strip denotes the stock material rolled later in time sequence, and when the deviation between the target strip crown for the previous strip and the target strip crown for the next strip in rolling the next strip after rolling the previous strip is zero, the actuator set values in respect of the next strip are successively corrected on the basis of the deviations between the respective observed values of rolling status for the previous strip and the respective calculated values of the set-up rolling conditions for the next strip;

wherein, instead of zero deviation between the target strip crown for the previous strip and target strip crown for the next strip being taken as the criterion, zero deviation between the target strip crown for the next strip and observed strip crown in the previous strip may be taken as the criterion.

The aforesaid object of the present invention is further attained by providing a method and apparatus for rolling mill control constituted as follows.

Thus, the present invention is so constituted that, in controlling a plurality of rolling mills arranged in tandem each possessing an actuator for controlling the strip crown:

the set-up rolling conditions including the target values of rolling load, strip width and strip crown and the actuator set values in respect of the stock material to be rolled first, are calculated before rolling of the stock material on the basis of externally provided rolling information, the rolling status including rolling load, strip width and strip crown is measured during rolling of the stock material, the deviations are calculated between the respective observed values of rolling status for the previous strip, wherein leading strip denotes the stock material rolled earlier in time sequence in the successive rolling of stock material with the rolling mills, and the respective calculated values of the set-up rolling conditions for the next strip corresponding to the said observed values, wherein next strip denotes the stock material rolled later in time sequence, and when the deviation between the target strip crown for the previous strip and the target strip crown for the next strip on the delivery side of the final stand is non-zero in rolling the next strip after rolling the previous strip, the deviation is multiplied by a pre-set adjustment coefficient and further multiplied by the strip thickness ratio expressed as the ratio of strip thickness on the delivery side of the pertinent stand to the strip thickness on the delivery side of the final stand to obtain a correction to the set value of the strip crown for the pertinent stand, the correction is added to the correction to the set value of the strip crown for the rolling mill stand preceding the pertinent stand multiplied by the heredity coefficient of the pertinent stand to obtain a correction to strip crown at the pertinent stand, and the actuator set values are successively corrected on the basis of the correction to strip crown;

wherein, instead of a non-zero deviation between the target strip crown for the next strip on the delivery side of the final stand and the target strip crown for the previous strip being taken as the criterion, a non-zero deviation between the target strip crown for the next strip and the observed strip crown of the previous strip may be taken as the criterion.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE EMBODIMENT

Figure 1:
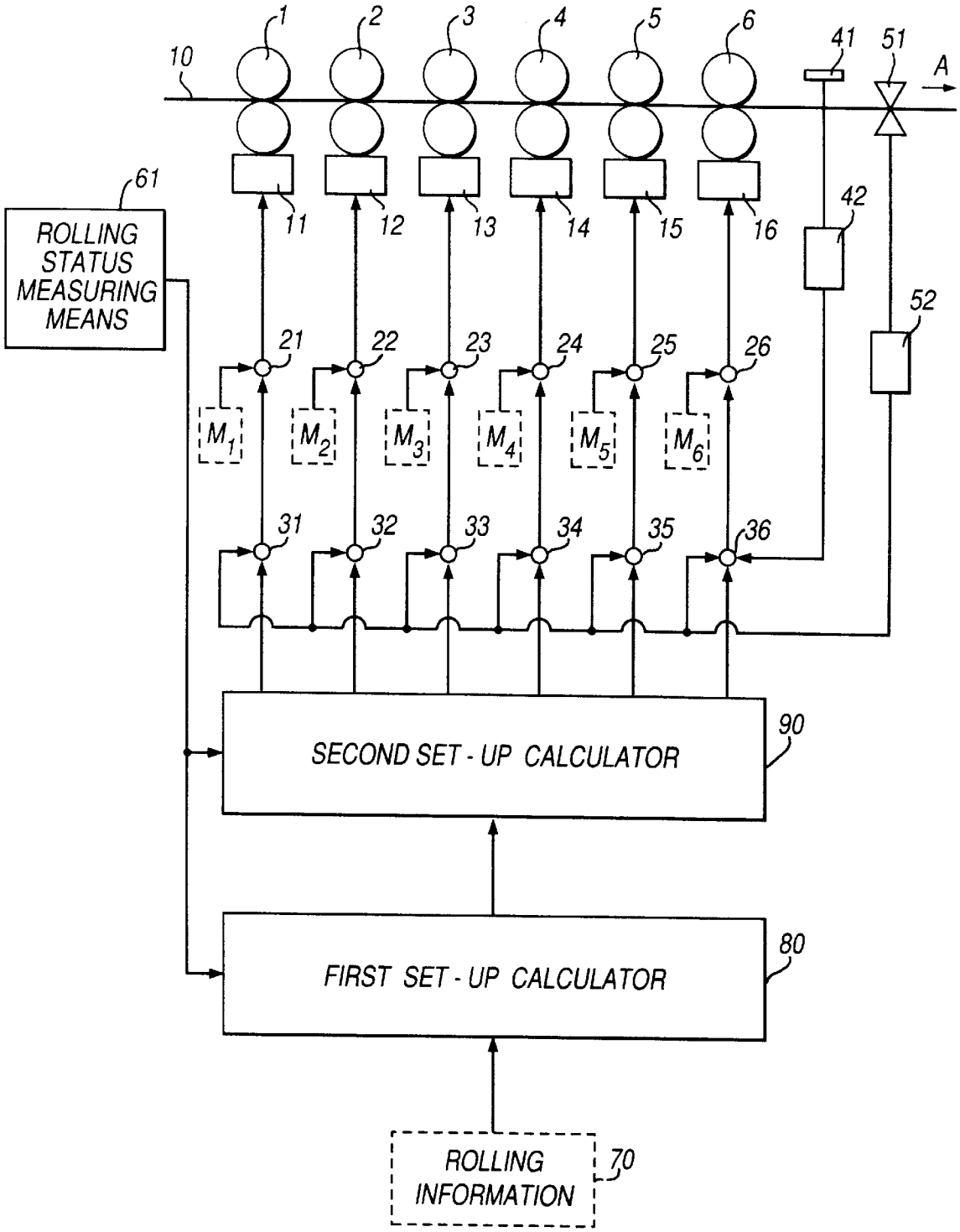
FIG. 1 is a block diagram showing the outline configuration of an embodiment of the apparatus of the present invention for the control of rolling mills, together with the rolling mills whereto the present invention applies.

Referring now to the drawings, wherein like reference numerals designate identical or corresponding parts throughout the several views, and more particularly to FIG. 1 thereof, one embodiment of the present invention will be described.

The present invention is hereunder described in detail with reference to a preferred embodiment.

FIG. 1 is a block diagram showing the outline configuration of an embodiment of the present invention, together with the rolling mills whereto the present invention applies; wherein the rolling mill stands 1–6 together constitute a 6-stand continuous rolling mill and the stock material (hereinafter simply called the material) 10 is rolled in the direction of the arrow A. The respective stands 1–6 are equipped with actuators 11–16 for controlling the strip crown and strip flatness. There are various kinds of actuator, and the rolling mills indicated in (a) to (d) hereunder are representative of mills equipped therewith:

(a) a pair-cross rolling mill, namely a four-high rolling mill wherein the top work rolls and top back-up rolls are paired and the bottom work rolls and bottom back-up rolls are paired, with a function for mutually crossing the roll pairs in the rolling direction and possessing other functions for bending the work rolls, shifting the work rolls axially, etc.;

(b) a CVC four-high rolling mill, namely a four-high rolling mill with a function for axially shifting work rolls whose diameter is varied in the axial direction, and possessing other functions such as bending the work rolls;

(c) a six-high rolling mill, namely a six-high rolling mill with functions for bending the work rolls, bending the intermediate rolls, axially shifting the work rolls, axially shifting the intermediate rolls, etc.;

(d) a CVC six-high rolling mill, namely a six-high rolling mill with functions for bending the work rolls, bending the intermediate rolls, axially shifting the work rolls, axially shifting the intermediate rolls whose diameter is varied in the axial direction, etc.

The actuators 11–16 shown in FIG. 1 denote collectively the aforementioned rolling mill functions and in the following description are addressed respectively to the control of a means of altering the pair cross angle with a large capacity for correcting the strip crown and a means of altering the roll bending force; wherein the control system of actuators 11–16 is equipped with adders 21–26 for respectively inputting corrections $M_1$–$M_6$ made manually by the operator, adders 31–35 for inputting corrections to the actuator set values for correction of the strip crown in respect of the actuators 11–15 during rolling, and an adder 36 for inputting a correction to the actuator set values for correction of the strip flatness in respect of the actuator 16 during rolling.

A strip flatness meter 41 is provided on the delivery side of the final mill stand 6 and a strip flatness controller 42 applies a correction for the set-up in respect of the actuator 16 to the adder 36 so that the detected strip flatness approaches the target value. In addition, a strip crown meter 51 is provided on the delivery side of the final mill stand 6 and a strip crown controller 52 applies corrections for the set values in respect of the actuators 11–15 to the adders 31–35 so that the detected strip crown approaches the target value.

Although not illustrated here, the stands 1–6 are equipped with reduction controllers controlling the roll gaps and main machine speed controllers controlling the roll peripheral velocities; and are further equipped with load detectors for detecting the rolling force (rolling load), strip width gauges for detecting the delivery strip width, and strip crown meters, etc. To simplify the drawing, the said detectors are here represented collectively as a rolling status measuring means 61. Provision is made so that rolling status information from the rolling status measuring means 61 is input to a first set-up calculator 80 and a second set-up calculator 90.

The rolling information 70 collectively denotes the pre-rolling information such as the steel type, pre-rolling thickness, strip width and material temperature, etc., set by the higher level computer (not illustrated) and the post-rolling information comprising the target values of rolled strip thickness, strip width, material temperature, strip crown and strip flatness, and is sometimes called the rolling instruction file; wherein provision is made for the rolling information 70 to be applied to the first set-up calculator 80 and second set-up calculator 90.

Figure 2:
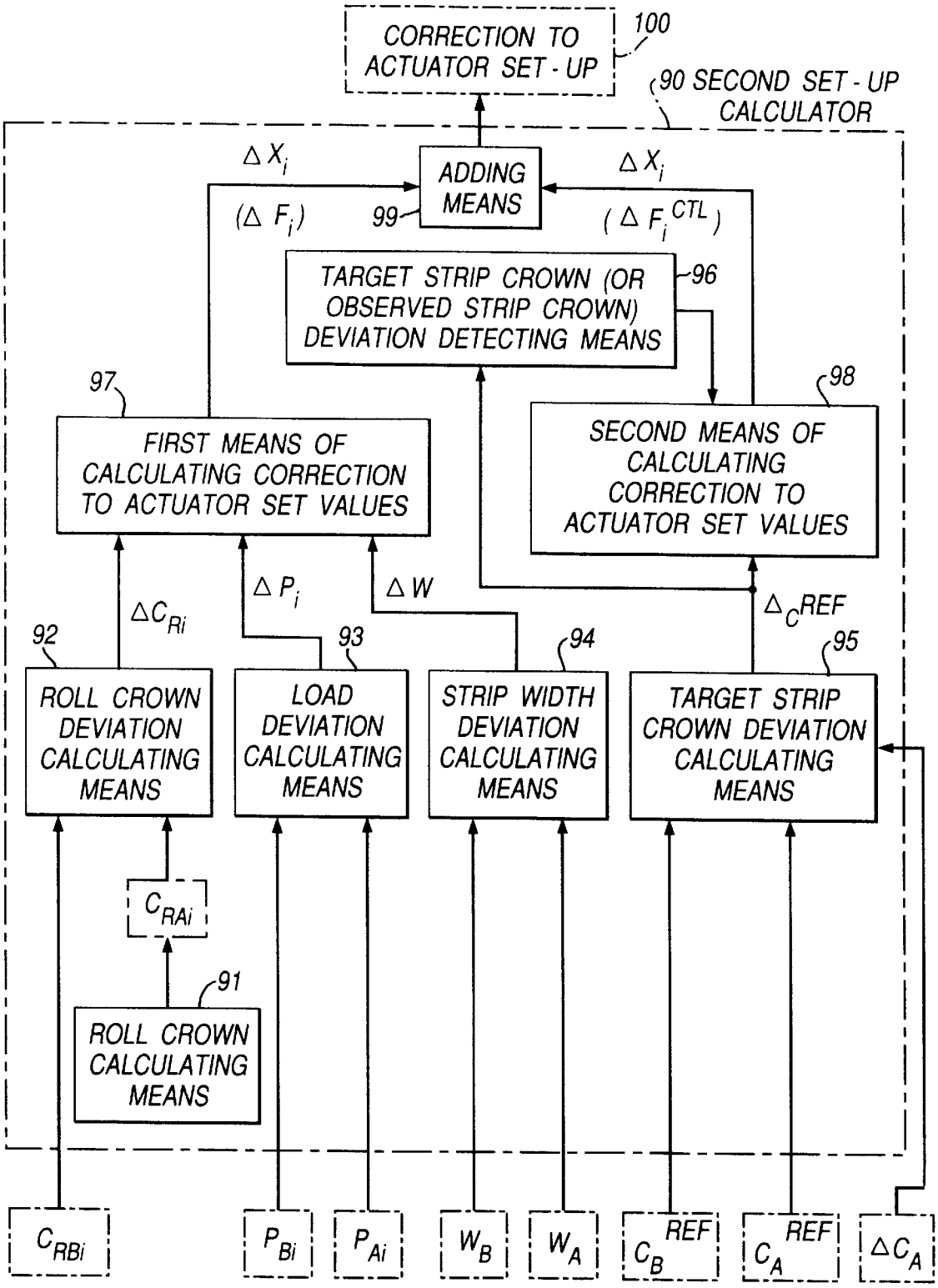
FIG. 2 is a block diagram showing the detailed configuration of key elements of the embodiment.

FIG. 2 is a block diagram showing the detailed configuration of the second set-up calculator 90. The second set-up calculator 90 calculates the correction 100 to the actuator set-values after rolling of the previous strip and before rolling of the next strip. It is therefore equipped with a roll crown calculating means 91 for both calculating the roll crown at specified time intervals and making predictive calculations, a roll crown deviation calculating means 92 for finding the deviation in roll crown for the previous strip and next strip, a load deviation calculating means 93, a strip width deviation calculating means 94, and a target strip crown deviation calculating means 95, and is further provided with a target strip crown deviation detecting means 96 for discriminating between a zero or non-zero output from the target strip crown deviation calculating means 95, an actuator set value first correction calculating means 97 for finding the actuator correction on the basis of the deviations in roll crown, load and strip width, an actuator set value second correction calculating means 98 for finding the actuator correction on the basis of the deviation from the target strip crown, and an adding means 99 for summing the corrections so found and outputting the sum.

Operation of the embodiment thus constituted is hereunder explained with reference to FIG. 3.

Figure 3A:
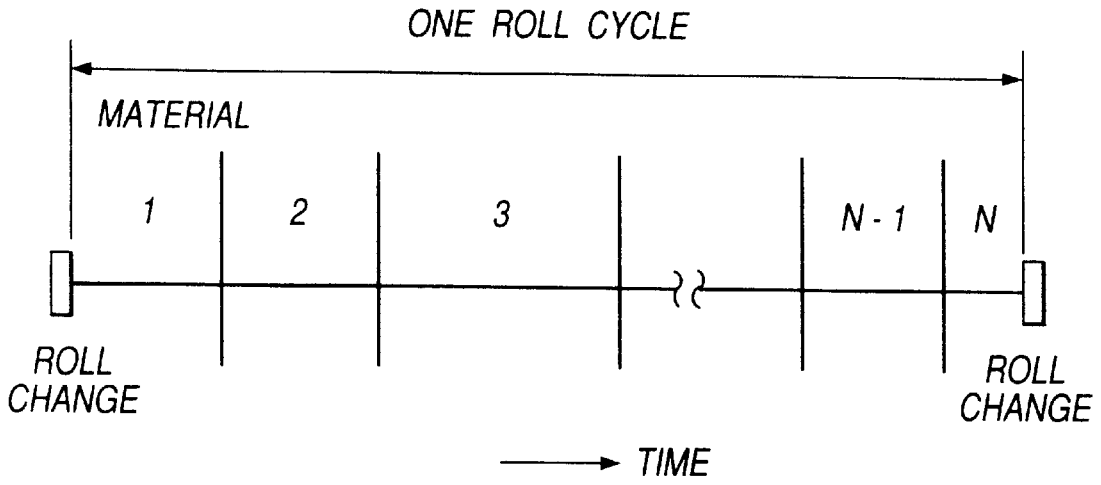
FIG. 3 is an explanatory diagram explaining the typical mode of rolling in rolling mills whereto the present invention is applied.
Figure 3B:
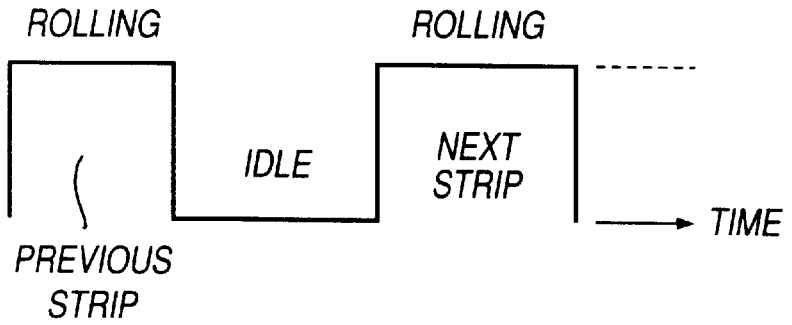
Figure 3C:
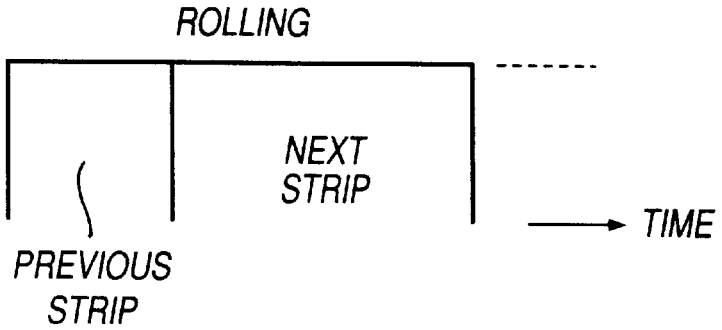

In general, the time from one roll change to the next roll change in a tandem rolling mill is called a roll cycle, during which materials may be continuously rolled in the sequence material 1, material 2, . . . , material N as shown in FIG. 3(*a*). If materials 1 and 2 are singled out for attention, material 1 then constitutes the previous strip while material 2 constitutes the next strip. Similarly, if materials N−1 and N are singled out for attention, material N−1 then constitutes the previous strip while material N constitutes the next strip.

One mode of rolling during a roll cycle is a mode called batch rolling wherein as shown FIG. 3(*b*) a time during which no strip is rolled, i.e. an idle time, is provided at some point during the roll cycle; and if the material rolled directly before the idle time in the present embodiment is denoted the previous strip, the material rolled directly after the idle time is defined as the next strip.

Another mode of rolling during a roll cycle is a mode called endless rolling as shown in FIG. 3(*c*) wherein the tail end of the material rolled first is joined by welding, etc., to the head end of the material rolled afterwards so that the materials are rolled endlessly; wherein supposing the materials are rolled in a mutually joined state, the material rolled first is defined as the previous strip and the material rolled afterwards is defined as the next strip.

Before the next strip is rolled, the pre-rolling information such as type of steel, strip thickness, strip width and material temperature on the stand entry side, and the post-rolling information comprising the target values of strip thickness, strip width, material temperature and strip flatness on the stand delivery side are applied as the rolling information 70 to the first set-up calculator 80 and second set-up calculator 90. The first set-up calculator 80 calculates the set values of strip thickness, strip width, rolling load, rolling torque, material temperature and leading ratio of slip on the delivery side of stands 1–6 for the next strip on the basis of the rolling information 70, and based on the results of these calculations, further calculates the set values of roll gap, roll peripheral velocity, etc., in each of the stands 1–6, the set values being applied to the second set-up calculator 90 and also to the respective controllers not illustrated herein. At the same time, feedback control or feed-forward control is implemented using the results of measurements with the rolling status measuring means 61, though since this is a known art variously proposed, a description thereof will be omitted. Similarly, the computation of corrections to the actuator set values of the stand 6 by means of the strip flatness controller 42 on the basis of the values detected with the strip flatness meter 41 and application of the said corrections to the adder 36, and the computation of corrections to the actuator settings of the stands 1–5 by means of the strip crown controller 52 on the basis of the values detected with the strip crown meter 51 and application of the said corrections to the adders 31–35, are also known art variously proposed and a description thereof will be omitted.

A detailed explanation will now be given of the operation of the second set-up calculator 90 provided to improve the precision of strip crown and strip flatness in the next strip based on the rolling status of the previous strip.

The pre-rolling information and post-rolling information are generally different for the previous strip and next strip. Moreover, rolling mill rolls are subject to continual variations in roll geometry due to thermal expansion from rolling, contraction from cooling, roll wear from rolling, and so on. To bring the strip crown and strip flatness to the target values under such conditions, the strip width, rolling load, actuator state variables (pair-cross angle, roll bending force, etc.), strip crown and strip flatness during rolling of the previous strip, preferably the tail end portion thereof, are detected with the rolling status measuring means 61 and applied to the second set-up calculator 90.

The roll crown calculating means 91 constituting the second set-up calculator 90 calculates the roll crown $C_{RAi}$ in rolling of the previous strip by the i.th stand, where i (=1~6) denotes the stand number, and also calculates the predicted roll crown $C_{RBi}$ for rolling the next strip. The roll crown deviation calculating means 92 executes the following calculation and outputs the roll crown deviation $\Delta CR_{Ri}$:

$$\Delta C_{Ri}=C_{RBi}-C_{RBi} \tag{1}$$

The observed rolling load $P_{Ai}$ during rolling of the previous strip by the i.th stand and the target rolling load $P_{Bi}$ for rolling the next strip are input to the load deviation calculating means 93, which calculates the load deviation $\Delta P_i$ with the equation:

$$\Delta P_i=P_{Bi}-P_{Ai} \tag{2}$$

In addition, the observed strip width $W_A$ on the delivery side of the final stand, stand 6, during rolling of the previous strip and the target strip width $W_B$ for rolling the next strip are input to the strip width deviation calculating means 94, which calculates the roll width deviation $\Delta W$ with the equation:

$$\Delta W=W_B-W_A \tag{3}$$

Similarly, the target strip crown $C_A^{REF}$ on the delivery side of the final stand, stand 6, during rolling of the previous strip by the final-stand,stand 6 and the target strip crown $C_B^{REF}$ for rolling the next strip are input to the target strip crown deviation calculating means 95, which calculates the deviation $\Delta C^{REF}$ from the target strip crown with the equation:

$$\Delta C^{REF}=C_B^{REF}-C_A^{REF} \tag{4}$$

Although corrections are also made by the operator at the tail end during rolling of the previous strip, the strip crown measured with the rolling status measuring means 61 may show a deviation $\Delta C_A$ with respect to the target strip crown $C_A^{REF}$.

In this event, the target strip crown deviation calculating means 95 carries out the following calculation:

$$\Delta C^{REF}=\Delta C_B^{REF}-(C_A^{REF}+\Delta C_A) \tag{5}$$

where $\Delta C^{REF}$ is the deviation from the target strip crown on the delivery side of the final stand, stand 6.

In general the roll crown deviation $\Delta C_{Ri}$ in Equation (1), the load deviation $\Delta P_i$ in Equation (2) and the strip width deviation $\Delta W$ in Equation (3) are different for the previous strip and next strip. The target strip crown deviation detecting means 96 discriminates between a zero and non-zero value of $\Delta C^{REF}$ from the target strip crown deviation calculating means 95, i.e. discriminates between a zero and non-zero target strip crown deviation $\Delta C^{REF}$ in Equation (4) or Equation (5) ; wherein a target strip crown deviation $\Delta C^{REF}$ of zero in Equation (4) signifies that the deviation between the target strip crown of the previous strip and the target strip crown of the next strip is zero, while a target strip crown deviation $\Delta C^{REF}$ of zero in Equation (5) signifies that the deviation between the target strip crown of the next strip and the observed strip crown of the previous strip is zero.

If the strip crown target deviation $\Delta C^{REF}$ of Equation (4) or Equation (5) is zero, only the actuator set-up first correction calculating means 97 calculates the corrections to the actuator set values; since its input is zero, the actuator set value second correction calculating means 98 makes no calculation and the output therefrom is zero. Operation of the actuator correction first calculating means 97 will therefore be described hereunder together with the principle thereof assuming the strip crown target deviation $\Delta C^{REF}$ is zero.

In general, the cross-pair angle whereby roll pairs are mutually crossed in the rolling direction has a larger strip crown correcting capability than the bending force of the roll bender. Determination of the correction to the pair-cross angle will therefore be considered first.

The following relation obtains between the correction $\Delta X_i$ to the pair-cross angle of stand i and the aforementioned load deviation $\Delta P_i$, strip width deviation $\Delta W$ and roll crown deviation $\Delta C_{R1}$:

$$\frac{\partial C_i}{\partial X_i}\cdot\Delta X_i=\frac{\partial C_i}{\partial P_i}\cdot\Delta P_i+\frac{\partial C_i}{\partial W}\cdot\Delta W+\frac{\partial C_i}{\partial C_{Ri}}\cdot\Delta C_{Ri} \tag{6}$$

Equation (6) can be rearranged as follows:

$$\Delta X_i=\frac{1}{\left(\frac{\partial C_i}{\partial X_i}\right)}\cdot\left(\frac{\partial C_i}{\partial P_i}\cdot\Delta P_i+\frac{\partial C_i}{\partial W}\cdot\Delta W+\frac{\partial C_i}{\partial C_{Ri}}\cdot\Delta C_{Ri}\right) \tag{7}$$

where $\partial C/\partial X$: effect coefficient of pair-cross angle X with respect to strip crown $\partial C/\partial P$: effect coefficient of rolling load P with respect to strip crown $\partial C/\partial W$: effect coefficient of strip width W with respect to strip crown $\partial C/\partial C_R$: effect coefficient of roll crown $C_R$ with respect to strip crown subscript i: rolling mill stand number.

Of the quantities $\partial C_i/\partial X_i$, $\partial C_i/\partial P_i$, $\partial C_i/\partial W$ and $\partial C_i/\partial C_{Mi}$, the first is the effect co efficient of X on the strip crown, the second is the effect coefficient of rolling load on the strip crown, the third is the effect coefficient of strip width on the strip crown, and the fourth is the effect coefficient of roll crown on the strip crown, all whereof can be found by calculation or rolling mill tests if the rolling mill dimensions and the material to be rolled (the rolling schedule) are pre-defined; they are independently found and stored in a memory device (not illustrated) within the second set-up calculator 90.

On the other hand, for a rolling mill that does not use a pair-cross mill or does not have these actuators, the set values of the next strip crown and strip flatness are found as follows by correction of the roll bending force F.

The following relation obtains between the correction $\Delta F_i$ to the roll bender of stand i and the aforementioned load deviation $\Delta P_i$, strip width deviation $\Delta W$ and roll crown deviation $\Delta C_{Ri}$:

$$\frac{\partial C_i}{\partial F_i}\cdot\Delta F_i=\frac{\partial C_i}{\partial P_i}\cdot\Delta P_i+\frac{\partial C_i}{\partial W}\cdot\Delta W+\frac{\partial C_i}{\partial C_{Ri}}\cdot\Delta C_{Ri} \tag{8}$$

Equation (8) can be rearranged as follows:

$$\Delta F_i=\frac{1}{\left(\frac{\partial C_i}{\partial F_i}\right)}\cdot\left(\frac{\partial C_i}{\partial P_i}\cdot\Delta P_i+\frac{\partial C_i}{\partial W}\cdot\Delta W+\frac{\partial C_i}{\partial C_{Ri}}\cdot\Delta C_{Ri}\right) \tag{9}$$

where $\partial C/\partial F$: effect coefficient of roll bending force F with respect to the strip crown subscript i: rolling mill stand number.

The quantity $\partial C/\partial F$ is the effect coefficient of roll bending force on the strip crown and can be found by calculation or rolling mill tests if the rolling mill dimensions and the material to be rolled (the rolling schedule) are pre-defined; it is found independently and stored in a memory device (not illustrated) within the second set-up calculator 90.

The corrections $\Delta X_i$ or $\Delta F_i$ to the actuator set values thus found are output as the actuator set-up corrections 100 via the adding means 99.

The actuator set values for the material rolled first after a roll change are set by the first set-up calculator 80, whereas the observed values for the tail end of the previous strip provide the set values for the material rolled second and thereafter.

When the strip crown target deviation $\Delta C^{REF}$ of Equation (4) or Equation (5) is non-zero, the target strip crown deviation detecting means 96 applies a signal indicating this condition to the actuator set value second correction calculating means 98. The actuator set value second correction calculating means 98 calculates the corrections to the actuator set values to give a strip crown target deviation of zero, as follows.

Since the strip crown target deviation $\Delta C^{REF}$ is the deviation on the delivery side of the final stand 6, the actuator set values for all the stands 1–6 have to be corrected to make this deviation zero. Allowance must therein be made for inheritance by the following stand of the strip crown from the previous stand. Thus, the following relation obtains between the target strip crown deviation $\Delta C^{REF}$ and the correction $\Delta C^{CTL}$ to the actuator set values of the stand i:

$$\frac{\Delta C_i^{SUM}}{h_i}=\frac{\Delta C^{REF}}{h_6}\cdot\alpha_i \tag{10}$$

$$\Delta C_1^{SUM}=\eta_1\cdot\Delta C_{h1}^{SUM}+C_i^{CTL} \tag{11}$$

$$\Delta C_6^{SUM}=\Delta C^{REF} \tag{12}$$

where $\Delta C^{CTL}$: strip crown correction $\Delta C^{REF}$: deviation in target strip crown h: delivery strip thickness of stand $h_6$: delivery strip thickness or final stand $\eta$: heredity coefficient $\Delta C_i^{SUM}$: strip crown allowing for inheritance $\alpha$: adjustment coefficient ($0<\alpha\leqq 1.0$)

subscript i: rolling mill stand number.

Determination of the corrections $\Delta C_i^{CTL}$ to the actuator set values of the stands 1–6 using Equations (10) and (11) in order to make the strip crown target deviation $\Delta C^{REF}$ zero has the distinguishing feature that strip flatness does not deteriorate because the strip crown ratio correction is constant or assumes a certain proportion.

Once the strip crown corrections $\Delta C_i^{CTL}$ for the stands 1–6 have thus been found, the actuator corrections are obtained as hereinbefore described. In a pair cross mill of large capacity for correction of strip crown the following relation obtains between the corrections $\Delta X_i^{CTL}$ to the pair-cross angle and the strip crown corrections $\Delta C_i^{CTL}$:

$$\frac{\partial C_i}{\partial X_i}\cdot\Delta X_i^{CTL}=\Delta C_i^{CTL} \tag{13}$$

Hence:

$$\Delta X_i^{CTL} = \frac{\Delta C_i^{CTL}}{\left(\frac{\partial C_i}{\partial X_i}\right)} \quad (14)$$

$$(i = 1 - 6)$$

When the target deviation in the strip crown $\Delta C^{REF}$ is non-zero, the actuator set value second correction calculating means 98 determines the strip crown correction $\Delta C_i^{CTL}$ using Equations (10) and (11) and then determines the correction in pair-cross angle $\Delta X^{CTL}$ using Equation (14).

For a rolling mill that does not use a pair-cross or is not equipped with a means similar thereto, on the other hand, the set values in strip crown and strip flatness for the next strip are obtained as follows by correcting the roll bending force; wherein the following relation obtains between the correction $\Delta F_i^{CTL}$ in roll bending force and strip crown correction $\Delta C_i^{CTL}$:

$$\frac{\partial C_i}{\partial F_i} \cdot \Delta F_i^{CTL} = \Delta C_i^{CTL} \quad (15)$$

Hence:

$$\Delta F_i^{CTL} = \frac{\Delta C_i^{CTL}}{\left(\frac{\partial C_i}{\partial F_i}\right)} \quad (16)$$

$$(i = 1 - 6)$$

When the strip crown target deviation $\Delta C^{REF}$ is non-zero, corrections are found both with the actuator set-up first correction calculating means 97 and with the actuator set value second correction calculating means 98, and the said corrections are added by the adding means 99 to obtain the correction 100 to the actuator set value.

Thus, in a pair-cross mill, the sum of the correction to the pair-cross angle $\Delta X_i$ found with Equation (7) and the correction to the pair-cross angle $\Delta X_i^{CTL}$ found with Equation (14) affords the correction 100 to the actuator set-up. For a rolling mill that does not use a pair-cross or is not equipped with a means similar thereto, the sum of the correction $\Delta F_i$ to the roll bending force found with Equation (9) and the correction $\Delta F_i^{CTL}$ to the roll bending force found with Equation (16) affords the correction 100 to the actuator set value.

As will be clear from the foregoing explanation, correction is made only with the actuator correction afforded by the actuator set-up first correction calculating means 97 when the strip crown target deviation $\Delta C^{REF}$ is zero; when the strip crown target deviation $\Delta C^{REF}$ is non-zero, correction is made with the sum of the correction found with the actuator set-up first correction calculating means 97 and the correction found with the actuator set value second correction calculating means 97.

The aforesaid embodiment illustrates the case where correction is made to the pair-cross angle in a pair-cross rolling mill or to the roll bending force in a rolling mill that does not use a pair-cross mill or is not equipped with a means similar thereto. However, if a pair-cross rolling mill is equipped with a function for shifting the work rolls in the axial direction, it is equally permissible to correct the work roll shift.

Again, where a CVC four-high rolling mill is equipped with both a work roll shift function d is d a roll bending function, it is permissible to correct the work roll shift instead of using the roll bending function.

Furthermore, in a six-high rolling mill or a CVC six-high rolling mill, it is permissible to correct the work roll shift or intermediate roll shift instead of using the roll bending function.

Moreover, although the practical embodiment hereinbefore described was addressed to the control of a continuous rolling mill of 6 stands arranged in tandem, the present invention is not restricted thereto in its application. In an extreme case, the present invention is applicable to a single stand, and it is likewise applicable to virtually all continuous rolling mills comprising a plurality of stands.

Furthermore, whereas the aforesaid embodiment has the strip crown meter installed on the delivery side of the final stand and corrects the actuator set values of the upstream stands, when a strip crown meter is provided at an intermediate point in a plurality of stands it is possible to make the aforementioned correction at least in respect of stands upstream of the strip crown meter and also to make a similar correction in respect of stands downstream of the strip crown meter, from the stand following the strip crown meter to the final stand.

As will be clear from the foregoing description, the present invention consists in calculating the deviations between the respective observed values of rolling status for the previous strip and the respective calculated set-up values of rolling conditions for the next strip that correspond to the said observed values, and when the deviation between the target strip crown in the previous strip and the target strip crown in the next strip is zero or the deviation between the target strip crown in the next strip and the observed strip crown in the previous strip is zero in rolling the next strip after rolling the previous strip, successively correcting the actuator set values for the next strip on the basis of the deviation between the observed values of rolling status for the previous strip and the respective calculated set-up values of rolling status for the next strip) in consequence thereof, the strip crown and strip flatness of the succeeding stock material can be finished to the target values with high precision without recourse to the strip crown ratio heredity coefficient or shape disturbance coefficient by utilizing the rolling results for the previous strip for rolling control of the next strip.

The present invention is additionally constituted so that the deviations between the respective observed values of rolling status for the previous strip and the respective calculated set-up values of rolling conditions for the next strip that correspond to the said observed values are calculated, and when the deviation between the target strip crown in the previous strip and the target strip crown in the next strip is non-zero or the deviation between the target strip crown in the next strip and the observed strip crown in the previous strip is non-zero in the rolling of the next strip after rolling of the previous strip, the said deviation is multiplied by a pre-set adjustment coefficient and further multiplied by the strip thickness ratio expressed as the ratio of strip thickness on the delivery side of the pertinent stand to the strip thickness on the delivery side of the final stand to obtain a correction to the set value of the strip crown for the pertinent stand, whereupon the correction to the set value of the strip crown up to the rolling mill stand preceding the pertinent stand multiplied by the heredity coefficient of the pertinent stand is subtracted from the said correction to obtain the correction to the strip crown of the pertinent stand, and the actuator set values are successively corrected on the basis of the said correction to the strip crown; in consequence thereof, as hereinbefore stated, the strip crown and strip flatness of the succeeding stock material can be finished to the target values with high precision without recourse to the strip crown ratio heredity coefficient or shape disturbance coefficient by effectively utilizing the rolling results for the previous strip for rolling control of the next strip.

Obviously, numerous additional modifications and variations of the present invention are possible in the light of the above teachings. It is therefore to be understood that within the scope of the appended claims, the present invention may be practiced otherwise than as specially described herein.

What is claimed as new and desired to be secured by Letters Patent of the United States is:

1. A method for controlling rolling mills executing a process for controlling a plurality of stands arranged in tandem, each possessing an actuator for controlling a strip crown, said method comprising the steps of:

(1) calculating setup rolling conditions including target values of a rolling load, a strip width, a strip crown, and set values of said actuators in respect of a stock material to be rolled first on the basis of externally given rolling information;

(2) measuring a rolling status including said rolling load, said strip width, and said strip crown during rolling of said stock material;

(3) calculating deviations between respective observed values of a rolling status for a previous strip, said previous strip denoting said stock material rolled in a first time sequence in successive rolling of said stock material with said rolling mills, and respective calculated values of said setup rolling conditions for a next strip corresponding to said observed values, said next strip denoting said stock material rolled in a second time sequence occurring after said first time sequence; and (4) correcting said actuator set values for said next strip successively on the basis of said deviations between said respective observed values of the rolling status for said previous strip and said respective calculated values of said setup rolling conditions for said next strip when said deviation between a target strip crown for said previous strip and a target strip crown for said next strip is zero in rolling said next strip after rolling said previous strip.

2. A method according to claim 1, wherein the step of correcting further comprises:

taking zero deviation between said target strip crown for said next strip on a delivery side of a final stand and said observed strip crown in said previous strip as a criterion.

3. A method according to claim 1 or 2, further comprising the steps of:

multiplying respective effect coefficients for said strip crown into said deviation between said observed values of rolling status for said previous strip and said calculated setup rolling conditions for said next strip;

adding said values obtained by said multiplication; and dividing said value obtained by said addition by said effect coefficient of said actuators with respect to said strip crown to obtain a correction to said actuator set values.

4. A method according to claim 3, wherein:

said actuators are means of pairing top work rolls with top back-up rolls and pairing bottom work rolls with bottom back-up rolls and mutually crossing said roll pairs in a rolling direction, and said actuator set values and corrections are roll pair-cross angles.

5. A method according to claim 3, wherein:

said actuators are means of bending the work rolls and the actuator set values and corrections are bending forces.

6. A method for controlling rolling mills executing a process for controlling a plurality of stands arranged in tandem, each possessing an actuator for controlling a strip crown, said method comprising the steps of:

(1) calculating setup rolling conditions including target values of a rolling load, a strip width, a strip crown, and set values of said actuators in respect of a stock material to be rolled first on the basis of externally given rolling information;

(2) measuring a rolling status including said rolling load, said strip width, and said strip crown during rolling of said stock material;

(3) calculating deviations between respective observed values of a rolling status for a previous strip, said previous strip denoting said stock material rolled in a first time sequence in successive rolling of said stock material with said rolling mills, and respective calculated values of said setup rolling conditions for a next strip corresponding to said observed values, said next strip denoting said stock material rolled in a second time sequence occurring after said first time sequence;

(4) multiplying said deviation by a preset adjustment coefficient when said deviation between said target strip crown for said previous strip and said target strip crown for said next strip is non-zero in rolling said next strip after rolling said previous strip, and multiplying said deviation by a strip thickness ratio expressed as a ratio of strip thickness on a delivery side of a pertinent stand to a strip thickness on a delivery side of a final stand to obtain a correction to said set value of said strip crown up to the pertinent stand;

(5) subtracting said correction to said set value of said strip crown up to said rolling mill stand preceding said pertinent stand multiplied by a heredity coefficient of said pertinent stand from said correction to obtain a correction to said strip crown of said pertinent stand; and (6) correcting said actuator set values successively on the basis of said correction to the strip crown.

7. A method according to claim 6, wherein the step of correcting further comprises:

taking a non-zero deviation between said target strip crown for said next strip on a delivery side of the final stand and said observed strip crown in said previous strip as a criterion.

8. A method according to claim 1, 2, 6, or 7, wherein:

said actuators are means of pairing top work rolls with top back-up rolls and pairing bottom work rolls with bottom back-up rolls and mutually crossing said roll pairs in a rolling direction, and said actuator set values and corrections are roll pair-cross angles.

9. A method according to claim 1, 2, 6 or 7, wherein:

said actuators are means of bending the work rolls and the actuator set values and corrections are bending forces.

10. An apparatus for the control of rolling mills having a mechanism for controlling a plurality of stands arranged in tandem, each of said stands possessing an actuator for controlling a strip crown, said apparatus comprising:

a first setup calculating means for calculating setup rolling conditions including target values of a rolling load, a strip width, a strip crown, a set values of said actuators in respect of a stock material to be rolled first on the basis of externally given rolling information before rolling the stock material;

a rolling status measuring means for measuring a rolling status, including said rolling load, said strip width, and said strip crown, during rolling of said stock material; and a second setup calculating means calculating a deviation between respective observed values of a rolling status for a previous strip and respective calculated values of setup rolling conditions for a next strip corresponding to said observed values, said previous strip denoting stock materials rolled in a first time sequence and said next strip denoting the stock material rolled in a second time sequence occurring after the first time sequence in the successive rolling of stock materials with said rolling mill, and successively correcting said set values of said actuators in respect of said next strip on the basis of said deviation between said observed values of the rolling status for said previous strip and the calculated values of the setup rolling conditions for said next strip when said deviation between said target strip crown for said previous strip and said target strip crown for said next strip in rolling said next strip after rolling said previous strip is zero.

11. An apparatus according to claim 10, wherein:

a zero deviation between said target strip crown for said next strip on a delivery side of a final stand and said observed strip crown in said previous strip is taken as a criterion.

12. An apparatus according to claim 10, or 11, wherein:

said second set-up calculating means multiplies respective effect coefficients for said strip crown into said calculated deviations, adds values obtained by said multiplication, and divides a result of addition by said effect coefficient of said actuators in respect of said strip crown to obtain corrections to said actuator set values.

13. An apparatus according to claim 12, wherein:

said actuators are means of pairing top work rolls with top back-up rolls and pairing bottom work rolls with bottom back-up rolls and mutually crossing said roll pairs in a rolling direction, and said actuator set values and said corrections are roll pair-cross angles.

14. An apparatus according to claim 12, wherein:

said actuators are means of bending said work rolls and said actuator set values and said corrections are bending forces.

15. An apparatus for the control of rolling mills having a mechanism for controlling a plurality of stands arranged in tandem, each of said stands possessing an actuator for controlling a strip crown, said apparatus comprising:

a first setup calculating means for calculating setup rolling conditions including target values of a rolling load, a strip width, a strip crown, and set values of said actuators in respect of stock materials to be rolled first on the basis of externally given rolling information before rolling the stock material;

a rolling status measuring means for measuring rolling status including, said rolling load, said strip width, and said strip crown, during rolling of said stock material;

a second setup calculating means for (1) calculating a deviation between respective observed values of a rolling status for a previous strip and respective calculated values of setup rolling conditions for a next strip corresponding to said observed values, said previous strip denoting stock materials rolled in a first time sequence and said next strip denoting stock materials rolled in a second time sequence occurring after the first time sequence in the successive rolling of stock material with said rolling mill;

(2) multiplying a deviation by a preset adjustment coefficient and then by a strip thickness ratio expressed as said ratio of strip thickness on a delivery side of a pertinent stand to said strip thickness on a delivery side of said final stand to obtain a correction to said set value of said strip crown up to said pertinent stand on a condition that said deviation between said target strip crown of said previous strip and said target strip crown of said next strip on said delivery side of said final rolling stand in rolling said next strip after rolling said previous strip is non-zero;

(3) subtracting a correction to said set value of said strip crown up to said rolling mill stand preceding said pertinent stand multiplied by a heredity coefficient of said pertinent stand from said correction to obtain an additional correction to said strip crown of said pertinent stand; and (4) successively correcting said actuator set values on the basis of said corrections to the strip crown.

16. An apparatus according to claim 15, wherein:

a non-zero deviation between said target strip crown for said next strip on a delivery side of the final stand and said observed strip crown in said previous strip is taken as a criterion.

17. An apparatus according to claim 10, 11, 15 or 16, wherein:

said actuators are means of pairing top work rolls with top back-up rolls and pairing bottom work rolls with bottom back-up rolls and mutually crossing said roll pairs in a rolling direction, and said actuator set values and said corrections are roll pair-cross angles.

18. An apparatus according to claim 10, 11, 15 or 16, wherein:

said actuators are means of bending said work rolls and said actuator set values and said corrections are bending forces.

* * * * *